US011919123B2

(12) United States Patent
Kumar et al.

(10) Patent No.: US 11,919,123 B2
(45) Date of Patent: Mar. 5, 2024

(54) APPARATUS AND METHOD FOR CMP TEMPERATURE CONTROL

(71) Applicant: Applied Materials, Inc., Santa Clara, CA (US)

(72) Inventors: Surajit Kumar, San Jose, CA (US); Hari Soundararajan, Sunnyvale, CA (US); Hui Chen, San Jose, CA (US); Shou-Sung Chang, Mountain View, CA (US)

(73) Assignee: Applied Materials, Inc., Santa Clara, CA (US)

( * ) Notice: Subject to any disclaimer, the term of this patent is extended or adjusted under 35 U.S.C. 154(b) by 71 days.

(21) Appl. No.: 17/362,802

(22) Filed: Jun. 29, 2021

(65) Prior Publication Data

US 2021/0402555 A1 Dec. 30, 2021

Related U.S. Application Data

(60) Provisional application No. 63/046,411, filed on Jun. 30, 2020.

(51) Int. Cl.

| | |
|---|---|
| ***B24B 37/015*** | (2012.01) |
| ***B24B 37/10*** | (2012.01) |
| ***B24B 37/26*** | (2012.01) |
| ***B24B 41/047*** | (2006.01) |

(52) U.S. Cl.

CPC ..... *B24B 37/015* (2013.01); *B24B 37/107* (2013.01); *B24B 37/26* (2013.01); *B24B 41/047* (2013.01)

(58) Field of Classification Search

CPC ..... B24B 37/015; B24B 37/107; B24B 37/26; B24B 41/047; B24B 55/02; B24B 55/03; B24B 55/12; B24B 57/02; B24B 49/14

USPC ..... 451/7

See application file for complete search history.

(56) References Cited

U.S. PATENT DOCUMENTS

| | | | |
|---|---|---|---|
| 4,450,652 | A | 5/1984 | Walsh |
| 4,919,232 | A | 4/1990 | Lofton |
| 5,088,242 | A | 2/1992 | Lubbering et al. |
| 5,196,353 | A | 3/1993 | Sandhu et al. |

(Continued)

FOREIGN PATENT DOCUMENTS

| | | |
|---|---|---|
| CN | 101500721 | 8/2009 |
| CN | 102179757 | 9/2011 |

(Continued)

OTHER PUBLICATIONS

English translation of TWI258399B (Year: 2006).*

(Continued)

*Primary Examiner* — Joel D Crandall
*Assistant Examiner* — Sukwoo James Chang
(74) *Attorney, Agent, or Firm* — Fish & Richardson P.C.

(57) ABSTRACT

A chemical mechanical polishing apparatus includes a rotatable platen to hold a polishing pad, a carrier to hold a substrate against a polishing surface of the polishing pad during a polishing process, and a temperature control system including a source of heated or coolant fluid and a plenum having a plurality of openings positioned over the platen and separated from the polishing pad for delivering the fluid onto the polishing pad, wherein at least some of the openings are each configured to deliver a different amount of the fluid onto the polishing pad.

19 Claims, 4 Drawing Sheets

(56) References Cited

U.S. PATENT DOCUMENTS 5,478,435 A 12/1995 Murphy et al.
5,597,442 A 1/1997 Chen et al.
5,643,050 A 7/1997 Chen
5,709,593 A 1/1998 Guthrie
5,722,875 A 3/1998 Iwashita et al.
5,738,574 A 4/1998 Tolles et al.
5,762,544 A 6/1998 Zuniga et al.
5,765,394 A 6/1998 Rhoades
5,851,135 A 12/1998 Sandhu et al.
5,851,846 A 12/1998 Matsui et al.
5,868,003 A 2/1999 Simas et al.
5,873,769 A 2/1999 Chiou et al.
5,893,753 A 4/1999 Hempel, Jr.
5,957,750 A 9/1999 Brunelli
6,000,997 A 12/1999 Kao et al.
6,012,967 A 1/2000 Satake et al.
6,023,941 A 2/2000 Rhoades
6,095,898 A 8/2000 Hennofer et al.
6,121,144 A 9/2000 Marcyk et al.
6,151,913 A 11/2000 Lewis et al.
6,159,073 A 12/2000 Wiswesser et al.
6,257,954 B1 7/2001 Ng et al.
6,257,955 B1 7/2001 Springer et al.
6,264,789 B1 7/2001 Pandey et al.
6,280,289 B1 8/2001 Wiswesser et al.
6,315,635 B1 11/2001 Lin
6,319,098 B1 11/2001 Osterheld et al.
6,399,501 B2 6/2002 Birang et al.
6,422,927 B1 7/2002 Zuniga
6,461,980 B1 10/2002 Cheung et al.
6,494,765 B2 12/2002 Gitis et al.
6,543,251 B1 4/2003 Gasteyer, III et al.
6,640,151 B1 10/2003 Somekh et al.
6,647,309 B1 11/2003 Bone
6,776,692 B1 8/2004 Zuniga et al.
6,829,559 B2 12/2004 Bultman et al.
7,008,295 B2 3/2006 Wiswesser et al.
7,016,750 B2 3/2006 Steinkirchner et al.
7,196,782 B2 3/2007 Fielden et al.
8,133,756 B2 3/2012 Park et al.
8,349,247 B2 1/2013 Ueno
8,740,667 B2 6/2014 Kodera et al.
8,845,391 B2 9/2014 Sone et al.
9,005,999 B2 4/2015 Xu et al.
9,067,296 B2 6/2015 Ono et al.
9,475,167 B2 10/2016 Maruyama et al.
9,579,768 B2 2/2017 Motoshima et al.
9,630,295 B2 4/2017 Peng et al.
9,782,870 B2 10/2017 Maruyama et al.
9,969,046 B2 * 5/2018 Motoshima ..... B24B 53/017
10,035,238 B2 7/2018 Maruyama et al.
10,065,288 B2 * 9/2018 Wu ..... B24B 37/015
2001/0055940 A1 12/2001 Swanson
2002/0039874 A1 4/2002 Hecker et al.
2002/0058469 A1 5/2002 Pinheiro et al.
2002/0065002 A1 5/2002 Handa et al.
2003/0055526 A1 3/2003 Avanzino et al.
2003/0211816 A1 11/2003 Liu et al.
2004/0097176 A1 5/2004 Cron
2005/0024047 A1 2/2005 Miller et al.
2005/0042877 A1 2/2005 Salfelder et al.
2005/0181709 A1 8/2005 Jiang et al.
2005/0211377 A1 9/2005 Chen et al.
2007/0035020 A1 2/2007 Umemoto
2007/0135020 A1 6/2007 Nabeya
2007/0238395 A1 10/2007 Kimura et al.
2009/0258573 A1 10/2009 Muldowney et al.
2010/0047424 A1 2/2010 Cousin et al.
2010/0081360 A1 4/2010 Xu et al.
2010/0112917 A1 * 5/2010 Leighton ..... B24B 37/04 451/446
2010/0227435 A1 9/2010 Park et al.
2010/0279435 A1 11/2010 Xu et al.
2011/0159782 A1 * 6/2011 Sone ..... B24B 37/015 451/7
2012/0034846 A1 2/2012 Minamihaba et al.
2012/0040592 A1 2/2012 Chen et al.
2012/0190273 A1 7/2012 Ono et al.
2013/0023186 A1 1/2013 Motoshima et al.
2013/0045596 A1 2/2013 Eda et al.
2013/0331005 A1 12/2013 Akifumi et al.
2014/0024297 A1 1/2014 Cahndraeskaran et al.
2014/0187122 A1 7/2014 Ishibashi
2015/0024661 A1 1/2015 Peng et al.
2015/0196988 A1 7/2015 Watanabe
2015/0224621 A1 8/2015 Motoshima et al.
2015/0224623 A1 8/2015 Xu et al.
2016/0236318 A1 8/2016 Choi et al.
2017/0232572 A1 8/2017 Brown
2018/0236631 A1 8/2018 Eto et al.
2019/0126428 A1 5/2019 Martuyama et al.
2019/0143476 A1 5/2019 Wu
2020/0001426 A1 1/2020 Soundararajan et al.
2020/0001427 A1 1/2020 Soundararajan et al.
2020/0262024 A1 8/2020 Chang et al.
2021/0046602 A1 2/2021 Wu et al.
2021/0046603 A1 2/2021 Wu et al.
2021/0046604 A1 2/2021 Wu et al.

FOREIGN PATENT DOCUMENTS

CN 102419603 4/2012
CN 207171777 4/2018
JP H11-033897 2/1999
JP 2003-197586 7/2003
JP 2004-202666 7/2004
JP 2004-306173 11/2004
JP 2005-311246 11/2005
JP 2007-035973 2/2007
JP 2013-042066 2/2013
JP 2013-099814 5/2013
JP 2014-188596 10/2014
JP 2015-131361 7/2015
JP 2018-101738 6/2018
KR 10-2006-0076332 7/2006
KR 10-2009-0046468 5/2009
KR 10-2012-0084671 7/2012
KR 10-2015-0024781 3/2015
KR 10-1816694 1/2018
KR 10-2020-0056015 5/2020
TW I258399 B * 7/2006 ..... B24B 49/14
TW 202000368 1/2020
WO WO 1990/13735 11/1990
WO WO 2000/58054 10/2000
WO WO 2002/17411 2/2002
WO WO 2014/113220 7/2014
WO WO 2020/005749 1/2020

OTHER PUBLICATIONS

Banerjee et al., "Post CMP Aqueous and CO2 Cryogenic Cleaning Technologies for Low k and Copper Integration," CMPUG Symposium, Poster Abstract, Jan. 2015, 2 pages.
International Search Report and Written Opinion in International Appln. No. PCT/US2021/039691, dated Oct. 27, 2021, 9 pages.
Sampurno et al., "Pad Surface Thermal Management during Copper Chemical Mechanical Planarization," Presented Oct. 1, 2015 at lie International Conference on Planarization/CMP Technology, 2015, Sep. 30-Oct. 2, 2015, Session D-4, Chandler, AZ, USA, 24 pages.
Wu et al., "Pad Surface Thermal Management during Copper Chemical: Mechanical Planarization," ECS Journal of Solid State Science and Technology, Apr. 2015, 4(7):P206-12.
Machine Generated English Translation of CN 207171777, Published on Apr. 3, 2018, 25 pages (CN 207171777 submitted with Information Disclosure Statement on Nov. 18, 2021).
Office Action in Taiwanese Appl. No. 110123958, dated Apr. 18, 2022, 14 pages (with English summary).

* cited by examiner

APPARATUS AND METHOD FOR CMP TEMPERATURE CONTROL

CROSS-REFERENCE TO RELATED APPLICATIONS

This application claims priority to U.S. Application Ser. No. 63/046,411, filed on Jun. 30, 2020, the entire disclosure of which is incorporated by reference.

TECHNICAL FIELD

The present disclosure relates to chemical mechanical polishing (CMP), and more specifically to temperature control during chemical mechanical polishing.

BACKGROUND

An integrated circuit is typically formed on a substrate by the sequential deposition of conductive, semiconductive, or insulative layers on a semiconductor wafer. A variety of fabrication processes require planarization of a layer on the substrate. For example, one fabrication step involves depositing a filler layer over a non-planar surface and planarizing the filler layer. For certain applications, the filler layer is planarized until the top surface of a patterned layer is exposed. For example, a metal layer can be deposited on a patterned insulative layer to fill the trenches and holes in the insulative layer. After planarization, the remaining portions of the metal in the trenches and holes of the patterned layer form vias, plugs, and lines to provide conductive paths between thin film circuits on the substrate. As another example, a dielectric layer can be deposited over a patterned conductive layer, and then planarized to enable subsequent photolithographic steps.

Chemical mechanical polishing (CMP) is one accepted method of planarization. This planarization method typically requires that the substrate be mounted on a carrier head. The exposed surface of the substrate is typically placed against a rotating polishing pad. The carrier head provides a controllable load on the substrate to push it against the polishing pad. A polishing slurry with abrasive particles is typically supplied to the surface of the polishing pad.

SUMMARY

A chemical mechanical polishing apparatus includes a rotatable platen to hold a polishing pad, a carrier head to hold a substrate against a polishing surface of the polishing pad during a polishing process, and a temperature control system including a source of heated or coolant fluid and a plenum having a plurality of openings positioned over the platen and separated from the polishing pad for delivering the fluid onto the polishing pad.

In one aspect, at least some of the openings are each configured to deliver a different amount of the fluid onto the polishing pad.

In another aspect, each of a first plurality of radial positions along the plenum has at least two laterally separated openings, and wherein each of a second plurality of radial positions along the plenum has a single opening.

In another aspect, positions and sizes of the openings are such that a mass flow rate of the heated fluid through the plurality of openings increases substantially parabolicly with a distance from an axis of rotation of the platen.

In a further aspect, a method of controlling polishing includes measuring a radial temperature profile of a first polishing pad during polishing of a substrate, determining a pattern of openings that provide a mass flow profile to compensate for non-uniformity in the radial temperature profile, obtaining a base plate having openings arranged in the pattern, installing the base plate in an arm of a temperature control system of a chemical mechanical polishing system to form a plenum with the plurality of openings positioned over the platen, and polishing a substrate with a second polishing pad in the chemical mechanical polishing system while supplying a source of heated fluid to the plenum such that the heated gas flows through the plurality of openings onto the second polishing pad.

Implementations may include, but are not limited to, one or more of the following possible advantages. By quickly and efficiently raising or lowering temperatures across the surface of a polishing pad, a desired temperature control profile of the polishing pad can be implemented. The temperature of the polishing pad can be controlled without contacting the polishing pad with a solid body, e.g., a heat exchange plate, thus reducing risk of contamination of the pad and defects. Temperature variation over a polishing operation can be reduced. This can improve predictability of polishing the polishing process. Temperature variation from one polishing operation to another polishing operation can be reduced. This can improve wafer-to-wafer uniformity and improve repeatability of the polishing process. Temperature variation across a substrate can be reduced. This can improve within-wafer uniformity.

Plates with different patterns of apertures can be swapped into fluid dispenser to provide different temperature profiles. This permits quick testing for different temperature profiles or modification of a polisher for a process that requires a new temperature profile.

The details of one or more implementations are set forth in the accompanying drawings and the description below. Other aspects, features, and advantages will be apparent from the description and drawings, and from the claims.

BRIEF DESCRIPTION OF THE DRAWINGS

Like reference symbols in the various drawings indicate like elements.

DETAILED DESCRIPTION

Figure 1:
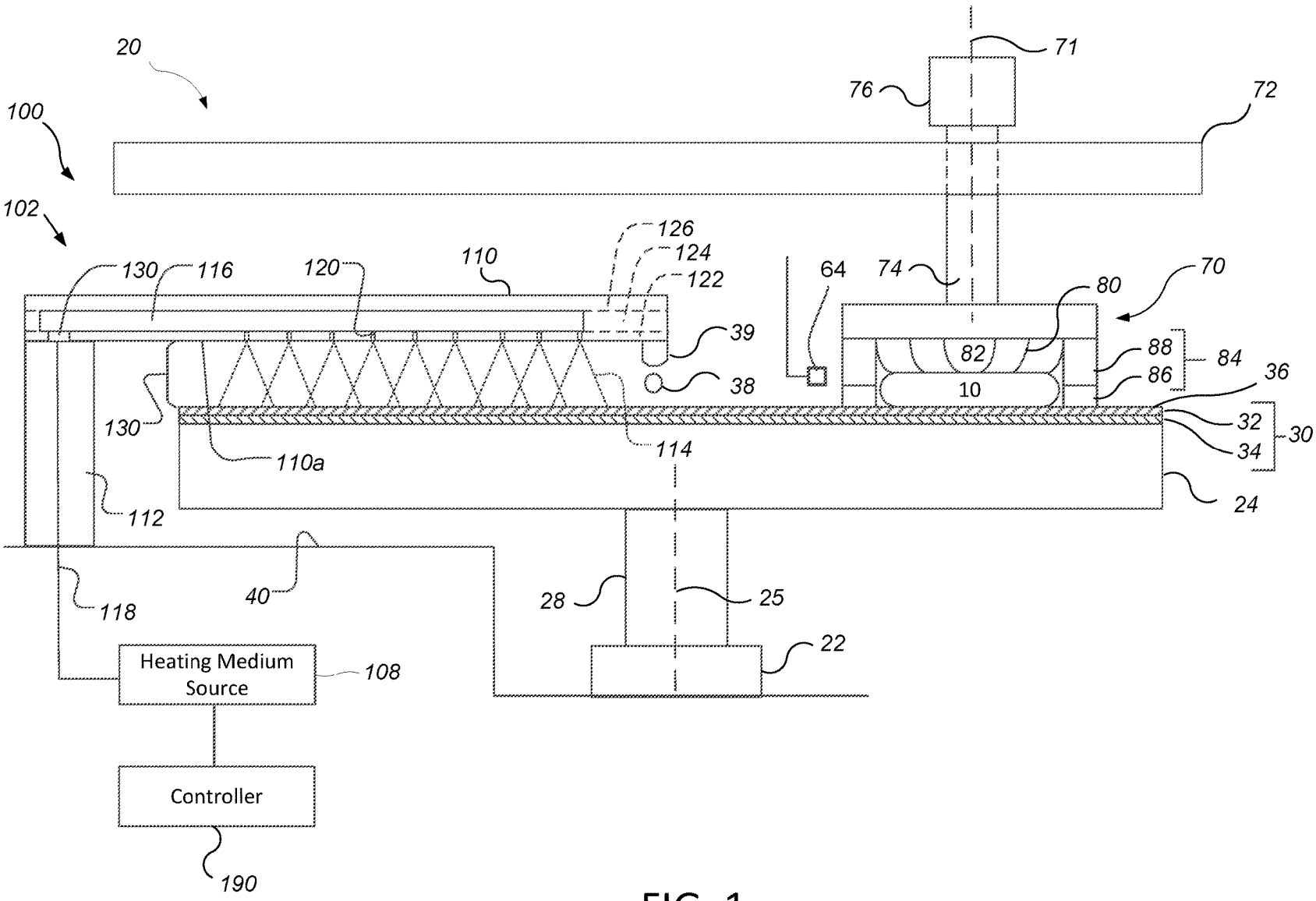
FIG. 1 illustrates a schematic cross-sectional view of an example of a polishing apparatus.

Chemical mechanical polishing operates by a combination of mechanical abrasion and chemical etching at the interface between the substrate, polishing liquid, and polishing pad. During the polishing process, a significant amount of heat is generated due to friction between the surface of the substrate and the polishing pad. In addition, some processes also include an in-situ pad conditioning step in which a conditioning disk, e.g., a disk coated with abrasive diamond particles, is pressed against the rotating polishing pad to condition and texture the polishing pad surface. The abrasion of the conditioning process can also generate heat. For example, in a typical one minute copper CMP process with a nominal downforce pressure of 2 psi and removal rate of 8000 Å/min, the surface temperature of a polyurethane polishing pad can rise by about 30° C.

Both the chemical-related variables in a CMP process, e.g., as the initiation and rates of the participating reactions, and the mechanical-related variables, e.g., the surface friction coefficient and viscoelasticity of the polishing pad, are strongly temperature dependent. Consequently, variation in the surface temperature of the polishing pad can result in changes in removal rate, polishing uniformity, erosion, dishing, and residue. By more tightly controlling the temperature of the surface of the polishing pad during polishing, variation in temperature can be reduced, and polishing performance, e.g., as measured by within-wafer non-uniformity or wafer-to-wafer non-uniformity, can be improved.

Some techniques have been proposed for temperature control. As one example, coolant could be run through the platen. As another example, a temperature of the polishing liquid delivered to the polishing pad can be controlled. However, these techniques can be insufficient. For example, the platen must supply or draw heat through the body of the polishing pad itself to control the temperature of the polishing surface. The polishing pad is typically a plastic material and a poor thermal conductor, so that thermal control from the platen can be difficult. On the other hand, the polishing liquid may not have a significant thermal mass.

A technique that could address these issues is to have a dedicated temperature control system (separate from the polishing liquid supply) that delivers a temperature-controlled medium, e.g., a liquid, vapor or spray, onto the polishing surface of the polishing pad (or the polishing liquid on the polishing pad).

An additional issue is that the temperature increase is often not uniform along the radius of the rotating polishing pad during the CMP process. Without being limited to any particular theory, different sweep profiles of the polishing head and pad conditioner sometimes can have different dwell times in each radial zone of the polishing pad. In addition, the relative linear velocity between the polishing pad and the polishing head and/or the pad conditioner also varies along the radius of the polishing pad. Moreover, the polishing liquid can act as a heat sink, cooling the polishing pad in the region to which the polishing liquid is dispensed. These effects can contribute to non-uniform heat generation on the polishing pad surface, which can result in within-wafer removal rate variations.

A technique that may address these issues is to have a dispenser with openings for fluid flow spaced and sized to provide non-uniform mass flow along the radius of the polishing pad. In particular, the pattern of openings along an arm of the dispenser, including the size of the openings and radial spacing of the openings, can be customized based on the specifics of a desired temperature control profile.

Figure 2:
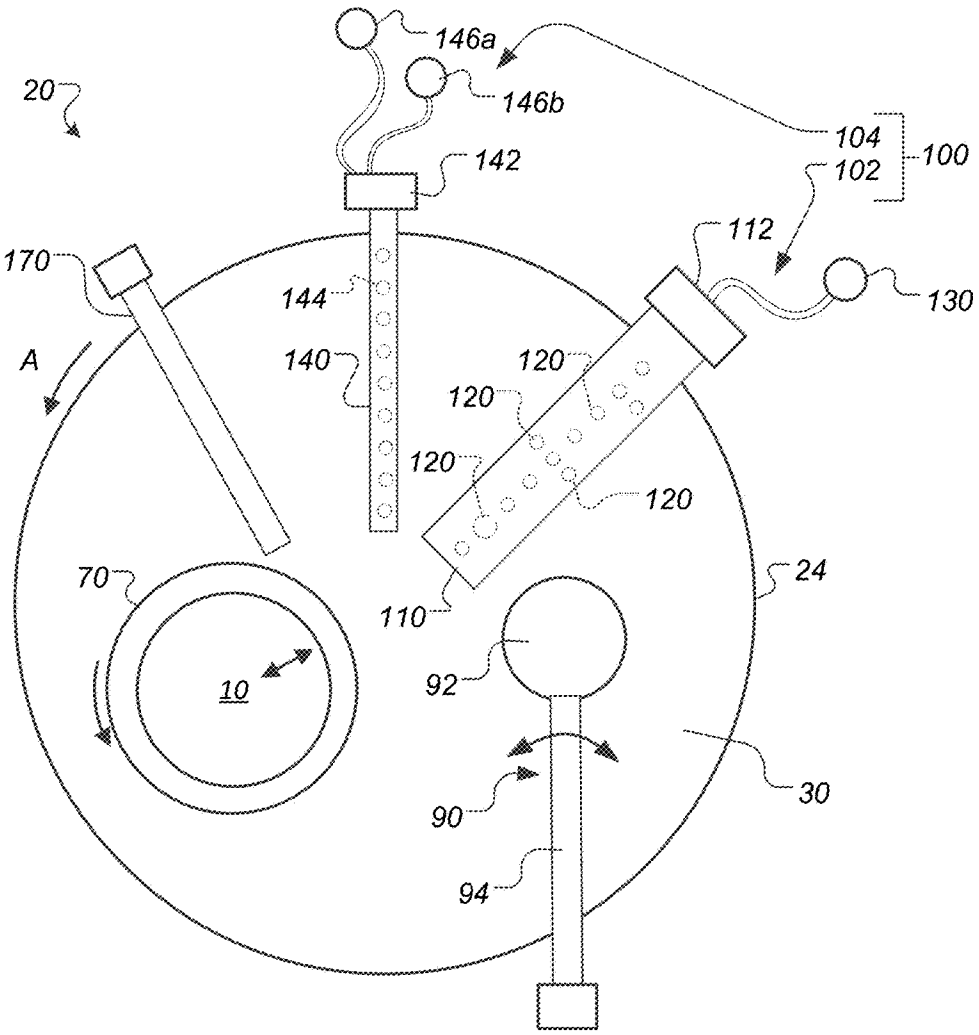
FIG. 2 illustrates a schematic top view of an example chemical mechanical polishing apparatus.

FIGS. 1 and 2 illustrate an example of a polishing station 20 of a chemical mechanical polishing system. The polishing station 20 includes a rotatable disk-shaped platen 24 on which a polishing pad 30 is situated. The platen 24 is operable to rotate (see arrow A in FIG. 2) about an axis 25. For example, a motor 22 can turn a drive shaft 28 to rotate the platen 24. The polishing pad 30 can be a two-layer polishing pad with an outer polishing layer 32 and a softer backing layer 34.

The polishing station 20 can include a supply port 39 to dispense a polishing liquid 38, such as an abrasive slurry, onto the polishing pad 30. The exact location of the supply port 39 may vary between different implementations, but typically, the supply port 39 is positioned at the end of an arm near the center of the polishing pad 30. For example, the supply port 39 can be positioned at the end of a heating delivery arm 110 (see FIG. 1). As another example, the supply port 39 can be positioned at the end of a slurry supply arm 170 (see FIG. 2). The polishing station 20 can include a pad conditioner apparatus 90 with a conditioning disk 92 (see FIG. 2) to maintain the surface roughness of the polishing pad 30. The conditioning disk 92 can be positioned at the end of an arm 94 that can swing so as to sweep the disk 92 radially across the polishing pad 30.

A carrier head 70 is operable to hold a substrate 10 against the polishing pad 30. The carrier head 70 is suspended from a support structure 72, e.g., a carousel or a track, and is connected by a drive shaft 74 to a carrier head rotation motor 76 so that the carrier head can rotate about an axis 71. Optionally, the carrier head 70 can oscillate laterally, e.g., on sliders on the carousel, by movement along the track, or by rotational oscillation of the carousel itself.

The carrier head 70 can include a retaining ring 84 to hold the substrate. In some implementations, the retaining ring 84 may include a lower plastic portion 86 that contacts the polishing pad, and an upper portion 88 of a harder material.

In operation, the platen is rotated about its central axis 25, and the carrier head is rotated about its central axis 71 and translated laterally across the top surface of the polishing pad 30.

The carrier head 70 can include a flexible membrane 80 having a substrate mounting surface to contact the back side of the substrate 10, and a plurality of pressurizable chambers 82 to apply different pressures to different zones, e.g., different radial zones, on the substrate 10. The carrier head can also include a retaining ring 84 to hold the substrate.

In some implementations, the polishing station 20 includes a temperature sensor 64 to monitor a temperature in the polishing station or a component of/in the polishing station, e.g., the temperature of the polishing pad and/or slurry on the polishing pad. For example, the temperature sensor 64 could be an infrared (IR) sensor, e.g., an IR camera, positioned above the polishing pad 30 and configured to measure the temperature of the polishing pad 30 and/or slurry 38 on the polishing pad. In particular, the temperature sensor 64 can be configured to measure the temperature at multiple points along the radius of the polishing pad 30 in order to generate a radial temperature profile. For example, the IR camera can have a field of view that spans the radius of the polishing pad 30.

In some implementations, the temperature sensor is a contact sensor rather than a non-contact sensor. For example, the temperature sensor 64 can be thermocouple or IR thermometer positioned on or in the platen 24. In addition, the temperature sensor 64 can be in direct contact with the polishing pad.

In some implementations, multiple temperature sensors could be spaced at different radial positions across the polishing pad 30 in order to provide the temperature at multiple points along the radius of the polishing pad 30. This technique could be use in the alternative or in addition to an IR camera.

Although illustrated in FIG. 1 as positioned to monitor the temperature of the polishing pad 30 and/or slurry 38 on the pad 30, the temperature sensor 64 could be positioned inside the carrier head 70 to measure the temperature of the substrate 10. The temperature sensor 64 can be in direct contact (i.e., a contacting sensor) with the semiconductor wafer of the substrate 10. In some implementations, multiple temperature sensors are included in the polishing station 22, e.g., to measure temperatures of different components of/in the polishing station.

The polishing system 20 also includes a temperature control system 100 to control the temperature of the polishing pad 30 and/or slurry 38 on the polishing pad. The temperature control system 100 can include a heating system 102 and/or a cooling system 104. At least one, and in some implementations both, of the heating system 102 and cooling system 104 operate by delivering a temperature-controlled medium, e.g., a liquid, vapor or spray, onto the polishing surface 36 of the polishing pad 30 (or onto a polishing liquid that is already present on the polishing pad).

For the heating system 102, the heating medium can be a gas, e.g., steam or heated air, or a liquid, e.g., heated water, or a combination of gas and liquid. The medium is above room temperature, e.g., at 40-120° C., e.g., at 90-110° C. The medium can be water, such as substantially pure deionized water, or water that includes additives or chemicals. In some implementations, the heating system 102 uses a spray of steam. The steam can includes additives or chemicals.

The heating medium can be delivered from a source 108, e.g., a steam generator, by flowing through a fluid delivery line 118, which can be provided by piping, flexible tubing, passages through solid bodies, or some combination thereof, to a plenum 116 in the heating delivery arm 110.

An example heating system 102 includes an arm 110 that extends over the platen 24 and polishing pad 30 from an edge of the polishing pad to or at least near (e.g., within 5% of the total radius of the polishing pad) the center of polishing pad 30. The arm 110 can be supported by a base 112, and the base 112 can be supported on the same frame 40 as the platen 24. The base 112 can include one or more actuators, e.g., a linear actuator to raise or lower the arm 110, and/or a rotational actuator to swing the arm 110 laterally over the platen 24. The arm 110 is positioned to avoid colliding with other hardware components such as the carrier head 70 and the conditioning disk 92.

Multiple openings 120 are formed in the bottom surface of the arm 110. Each opening 120 is configured to direct a heated fluid 114, e.g., gas or vapor, e.g., steam, onto the polishing pad 30. The openings 120 can be provided by holes or slots through a base plate 122. Alternatively or in addition, some or all of the openings can be provided by nozzles secured to the bottom of the base plate 122. A center plate 124 can be sandwiched between the base plate 122 and a top plate 126, and an aperture through the center plate 124 can provide the plenum 116. The openings 120 can be small enough, and the pressure in the plenum 116 high enough, that heated fluid forms a spray onto the polishing pad 30. The size of the opening is set, e.g., not adjustable during a polishing operation. For example, the base plate 122 can be removed from the polishing arm and the passages be machined to widen the openings or the nozzles could be replaced.

As will be described in more detail below with reference to FIG. 3, the multiple openings 120 are arranged in a pattern on the bottom surface that facilitate effective temperature control of the polishing pad 30 and/or slurry 38 on the polishing pad according to a desired temperature profile.

Although FIG. 1 illustrates equally sized openings 120 positioned along a longitudinal direction of the arm 110 and spaced at even intervals, this is not required. That is, the openings 120 could be distributed non-uniformly either radially, or angularly, or both. For example, as depicted in FIG. 2, two or more openings 120 can be positioned along a transverse direction of the arm 110. The openings 120 at different radial distances from the center of the platen 24 can be of different sizes, e.g., different diameters, from each other. Moreover, openings at the same radial distance, i.e., positioned in a line along the transverse direction, can be of different sizes. In addition, although FIGS. 1 and 2 illustrate nine and twelve openings, respectively, there could be a larger or smaller number of openings, e.g., three to two-hundred openings. Moreover, although FIG. 2 illustrates circular openings, the openings could be rectangular, e.g., square, elongated slots, or other shapes.

The various openings 120 can direct different amounts of heated fluid 114, e.g., steam, onto different zones, e.g., different radial or angular zones, on the polishing pad 30. Adjacent zones can overlap. Optionally, some of the openings 120 can be oriented so that a central axis of the spray from that opening is at an oblique angle relative to the polishing surface 36. The heated fluid, e.g., steam, can be directed from one or more of the openings 120 to have a horizontal component in a direction opposite to the direction of motion of polishing pad 30 in the region of impingement as caused by rotation of the platen 24.

The arm 110 can be supported by a base 112 so that the openings 120 are separated from the polishing pad 30 by a gap 130. The gap 130 can be 0.5 to 5 mm. In particular, the gap can be selected such that the heat of the heating fluid does not significantly dissipate before the fluid reaches the polishing pad. For example, the gap 130 can be selected such that steam emitted from the openings does not condense before reaching the polishing pad.

In some implementations, a process parameter, e.g., flow rate, pressure, temperature, and/or mixing ratio of liquid to gas, can be independently controlled for different groups of openings 120. This would require that the arm include multiple plenums, with each plenum connected to an independently controllable heater to independently control the temperature of the heated fluid, e.g., the temperature of the steam, to the respective plenum.

For the cooling system 104, the coolant can be a gas, e.g., air, or a liquid, e.g., water. The coolant can be at room temperature or chilled below room temperature, e.g., at 5-15° C. In some implementations, the cooling system 104 uses a spray of air and liquid, e.g., an aerosolized spray of liquid, e.g., water. In particular, the cooling system can have nozzles that generate an aerosolized spray of water that is chilled below room temperature. In some implementations, solid material can be mixed with the gas and/or liquid. The solid material can be a chilled material, e.g., ice, or a material that absorbs heat, e.g., by chemical reaction, when dissolved in water.

The cooling medium can be delivered by flowing through one or more apertures, e.g., holes or slots, optionally formed in nozzles, in a coolant delivery arm. The apertures can be provided by a manifold that is connected to a coolant source.

As shown in FIG. 2, an example cooling system 104 includes an arm 140 that extends over the platen 24 and polishing pad 30. The arm 140 can be constructed similarly to the arm 110 of the heating system, except as described below.

Along the direction of rotation of the platen 24, the arm 140 of the cooling system 104 can be positioned between the arm 110 of the heating system 102 and the carrier head 70. Along the direction of rotation of the platen 24, the arm 140 of the cooling system 104 can be positioned between the arm 110 of the heating system 102 and the slurry delivery arm 170. For example, the arm 110 of the 110 heating system 104, the arm 140 of the cooling system 102, the slurry delivery arm 170 and the carrier head 70 can be positioned in that order along the direction rotation of the platen 24.

The example cooling system 104 includes multiple openings 144 on the bottom of the arm 140. Each opening 144 is configured to deliver a coolant, e.g., a liquid, such as water, or a gas, such as air, onto the polishing pad 30. Similar to the openings 120 for the heated fluid, the openings 144 can also be arranged in a pattern on the bottom surface that facilitate effective temperature control of the polishing pad 30 and/or slurry 38 on the polishing pad according to a desired temperature profile.

The cooling system 104 can include a source 146*a* of liquid coolant medium and/or a gas source 146*b* (see FIG. 2). In some implementations, liquid from the source 146*a* and gas from the source 146*b* can be mixed in a mixing chamber, e.g., in or on the arm 140, before being directed through the openings 144. For example, the air and gas can be mixed in the plenum.

The polishing system 20 can also include a controller 190 to control operation of various components, e.g., the temperature control system 100. The controller 190 can be coupled to heating source 108 and/or the coolant source 146*a*, 146*b* to control a flow rate of the heating fluid and/or the coolant. For example, the controller 190 can control a valve or liquid flow controller (LFC) in the fluid delivery line 118. The controller 190 can be configured to receive the temperature measurements from the temperature sensor 64. The controller 190 can compare the measured temperature to a desired temperature, and generate a feedback signal to a control mechanism (e.g., actuator, power source, pump, valve, etc.) for the flow rate of the respective heating and coolant fluids. The feedback signal is used by the controller 190, e.g., based on an internal feedback algorithm, to cause the control mechanism to adjust the amount of cooling or heating such that the polishing pad and/or slurry reaches (or at least moves closer to) the desired temperature.

Although FIG. 2 illustrates separate arms for each subsystem, e.g., the heating system 102, cooling system 104 and rinse system 106, various subsystems can be included in a single assembly supported by a common arm. For example, an assembly can include a cooling module, a rinse module, a heating module, a slurry delivery module, and optionally a wiper module. Each module can include a body, e.g., an arcuate body, that can be secured to a common mounting plate, and the common mounting plate can be secured at the end of an arm so that the assembly is positioned over the polishing pad 30. Various fluid delivery components, e.g., plenums, tubing, passages, etc., can extend inside each body. In some implementations, the modules are separately detachable from the mounting plate. Each module can have similar components to carry out the functions of the arm of the associated system described above.

Figure 3:
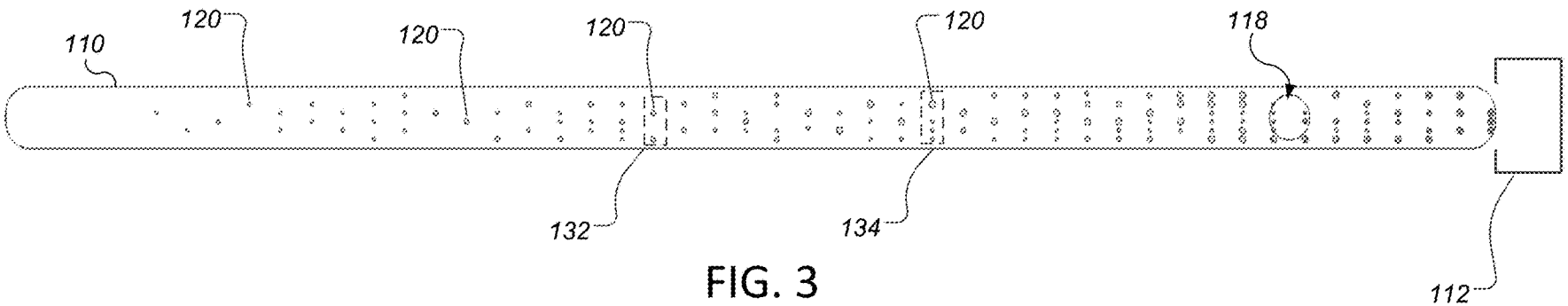
FIG. 3 illustrates a schematic bottom view of an example heating delivery arm of FIG. 1.

FIG. 3 illustrates a schematic bottom view of an example heating delivery arm 110 of FIG. 1. The arm 110 can be generally linear and can have a substantially uniform width along its length, although other shapes such as a circular sector (aka a "pie slice"), an arc or triangular wedge (all as bottom views of the system) can be used to achieve a desired effectiveness in temperature control of the polishing pad 30 and/or slurry 38 on the polishing pad. For example, the heating delivery arm 110 can be curved, e.g., form an arc or a portion of a spiral.

The heating delivery arm 110 can have a single inlet 119 through which the heating medium enters the plenum 116 in the arm 110. The inlet 119 can be located at a distal end of the arm 110 relative to the axis of rotation of the platen 24.

The heating delivery arm 110 has multiple openings 120 arranged in a pattern on the bottom surface 110*a*, e.g., through the base plate 122. The pattern of openings 120, including the size of the openings and radial or angular spacing of the openings, across the bottom surface of the heating delivery arm 110 can be designed to meet the specific needs of various temperature control profiles. In some cases, the temperature control profile can define mass flow rates of the heated fluid flow onto the polishing pad as a function of radial distance from an axis of rotation of the platen. For example, the mass flow rate can increase parabolically with distance from the axis of rotation.

In operation, the platen rotates in a tangential direction to a longitudinal direction of the arm 110. Thus, for convenience, the longitudinal direction of the arm 110 will also be referred to as the radial direction.

In the example implementation of FIG. 3, radially evenly distributed openings 120 are clustered more densely away from the axis of rotation of the platen, although the openings can be distributed differently and form other patterns. For example, the openings 120 can be spaced non-uniformly, i.e., at uneven intervals, along the radial direction. As another example, the openings 120 can be clustered more densely along a longitudinal edge of the arm 110.

At least some of the openings 120 have different sizes and/or shapes and thus deliver a different amount of the heated fluid, e.g., in terms of mass flow rate, onto the polishing pad. In addition, the size distribution of the openings 120 can be weighted more heavily to larger openings away from the axis of rotation of the platen. As depicted, the openings at the distal end of the arm are generally larger than the openings end of the arm that is closer to the axis of rotation of the platen.

At least some of the openings 120, e.g., the openings grouped by the tuple 132 or the quadruple 134, are laterally separated along a transverse direction of the arm 110. As such, some radial positions along the arm 110 each have at least two laterally separated openings, while some other radial positions along the arm 110 each have a single opening. That is, at least a pair of openings are positioned at a same radial distance from the axis of rotation of the platen.

Figure 4:
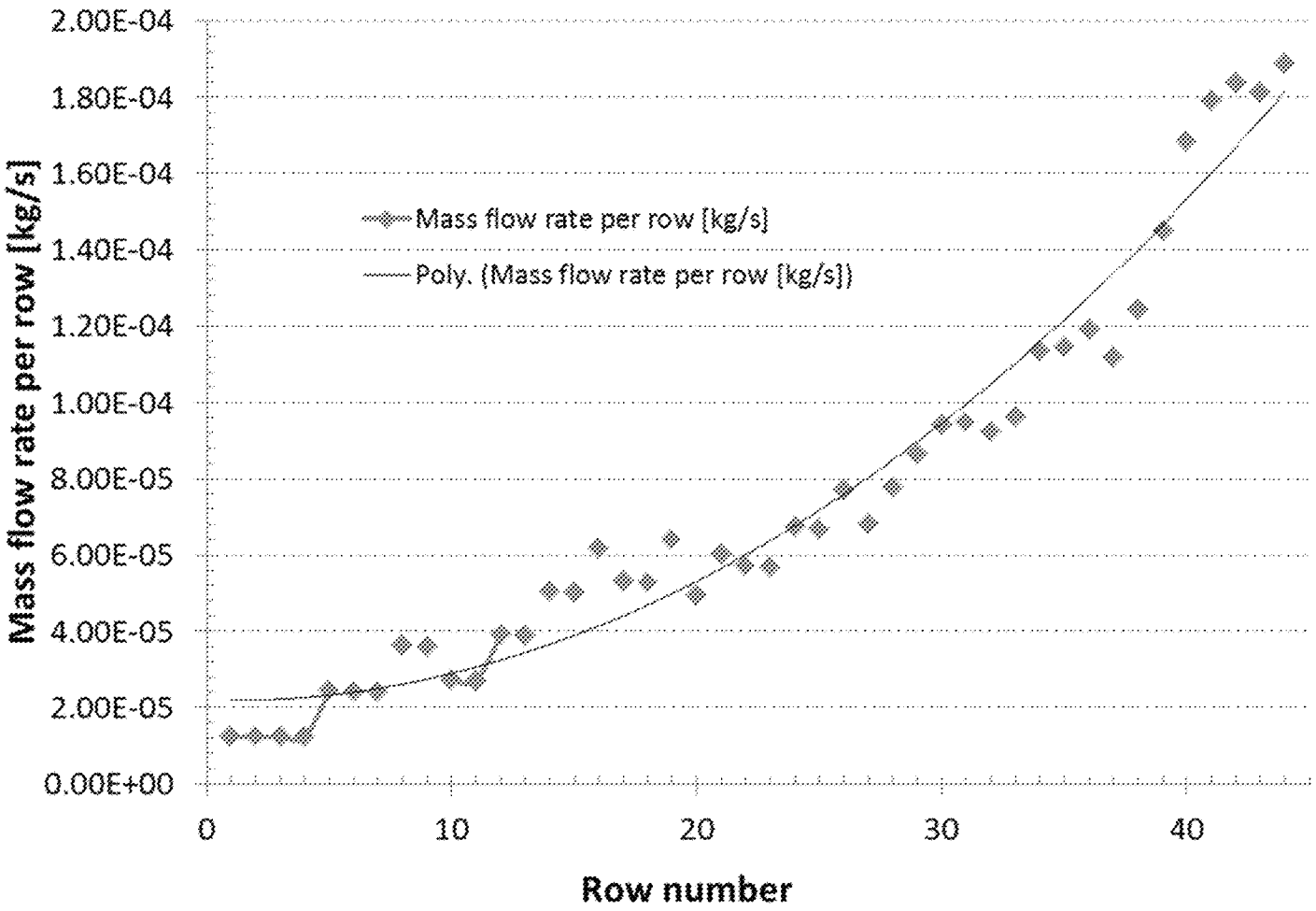
FIG. 4 presents mass flow rate as a function of radial distance from the axis of rotation of the platen of FIG. 1.

Referring to FIG. 4, as a particular example, a desired temperature control profile, as indicated by the solid curved line, defines mass flow rate as a non-linear, monotonically increasing function of radial distance from the axis of rotation of the platen. More specifically, the openings 120 are arranged to have a parabolic flow rates, which should result in a temperature profile that increases substantially linearly along the radial distance from the axis of rotation of the platen (because the area increases parabolically with radius, so that higher radius regions require more heating fluid).

FIG. 4 includes a plot including a vertical axis defining mass flow rate in units of kilograms per second (kg/s) and a horizontal axis defining radial distance in terms of number of circumferential rows away from the axis of rotation of the platen. For example, the rows can be spaced at even intervals of 0.2-4 cm, e.g., 0.6-1.0 cm.

By using the heating distribution arm 110 of FIG. 3, the temperature control system 100 is able to deliver heated fluids at respective mass flow rates which, as indicated by the scattered dots, closely align with the solid curved line and thereby effectively control the temperature of the polishing pad and/or slurry on the polishing pad according to the desired temperature control profile.

To change the distribution of heating fluid, the arm 110 can be removed and a new base plate 122 with a different pattern of openings swapped in. In some implementations, the base plate 122 can be removed from the arm without removing the arm 110 from the base 112. Thus, different plates with different patterns of openings can be used to provide different temperature profiles. This also permits quick testing for different temperature profiles or modification of a polisher for a process that requires a new temperature profile.

For example, a radial temperature profile during polishing of a substrate without temperature control by the arm can be measured. The a pattern of openings that will provide a mass flow profile to compensate for non-uniformity in the radial temperature profile is calculated, e.g., as an inverse of the radial temperature profile. A base plate having openings arranged in the pattern can be fabricate or selected from a set of pre-fabricated base-plates. Then the base plate is installed in the arm and used during polishing of a substrate.

The above described polishing apparatus and methods can be applied in a variety of polishing systems. Either the polishing pad, or the carrier heads, or both can move to provide relative motion between the polishing surface and the substrate. For example, the platen may orbit rather than rotate. The polishing pad can be a circular (or some other shape) pad secured to the platen. The polishing layer can be a standard (for example, polyurethane with or without fillers) polishing material, a soft material, or a fixed-abrasive material.

Terms of relative positioning are used to refer to relative positioning within the system or substrate; it should be understood that the polishing surface and substrate can be held in a vertical orientation or some other orientation during the polishing operation.

Functional operations of the controller 190 can be implemented using one or more computer program products, i.e., one or more computer programs tangibly embodied in a non-transitory computer readable storage media, for execution by, or to control the operation of, data processing apparatus, e.g., a programmable processor, a computer, or multiple processors or computers.

A number of embodiments of the invention have been described. Nevertheless, it will be understood that various modifications may be made without departing from the spirit and scope of the invention. For example, although heating fluids are described above, the arm of the cooling system can be configured similarly, but with a coolant flowing through the arm rather than a heated fluid. Similar advantages apply if the cooling system has an arm 140 with a similar physical structure. For example, the radial profile of the mass flow rate of the coolant can compensate for temperature non-uniformities, in this case by reducing the temperature rather than increasing the temperature.

Accordingly, other embodiments are within the scope of the following claims.

What is claimed is:

1. A chemical mechanical polishing apparatus comprising:

a rotatable platen to hold a polishing pad;

a carrier head to hold a substrate against a polishing surface of the polishing pad during a polishing process; and a temperature control system including a source of heated fluid and an arm extending over the platen, the arm having a base plate forming a bottom of the arm, wherein a plurality of openings having predetermined fixed sizes extend from a common plenum in the arm through the base plate, wherein the common plenum is coupled to the source of heated fluid, wherein the arm is located such that the openings are positioned over the platen and separated from the polishing pad by a gap to deliver the heated fluid from the common plenum onto the polishing pad, and wherein at least some of the openings are each differently sized so as to deliver a different amount of the fluid onto the polishing pad.

2. The apparatus of claim 1, comprising at least a pair of the openings are positioned at a same radial distance from an axis of rotation of the platen.

3. The apparatus of claim 1, wherein the openings are spaced non-uniformly along a radial distance from an axis of rotation of the platen.

4. The apparatus of claim 3, comprising a first plurality of radial positions along the common plenum where each position of the first plurality of radial positions has at least two laterally separated openings.

5. The apparatus of claim 4, comprising a second plurality of radial positions along the common plenum where each position of the second plurality of radial positions has a single opening.

6. The apparatus of claim 1, wherein a size of the openings and radial spacing of the openings is such that a mass flow rate of the fluid flow onto the polishing pad is a function of radial distance from an axis of rotation of the platen.

7. The apparatus of claim 6, wherein the mass flow rate is a non-linear function of radial distance from the axis of rotation of the platen.

8. The apparatus of claim 6, wherein the mass flow rate is a monotonically increasing function of radial distance from the axis of rotation of the platen.

9. The apparatus of claim 8, wherein the mass flow rate is a parabolically increasing function of radial distance from the axis of rotation of the platen.

10. The apparatus of claim 1, wherein the heated fluid comprises a heated gas.

11. The apparatus of claim 10, wherein the heated gas comprises steam.

12. The apparatus of claim 10, wherein the temperature control system includes a second arm extending over the platen, the second arm having a second base plate forming a bottom of the second arm, wherein a second plurality of second openings having predetermined fixed sizes extending from a second common plenum in the second arm through the second base plate, wherein the second common plenum is coupled to a source of coolant, wherein the arm is located such that the openings are positioned over the platen and separated from the polishing pad by a gap to deliver the coolant from the second common plenum onto the polishing pad, and wherein at least some of the second openings are each differently sized so as to deliver a different amount of the coolant onto the polishing pad.

13. The apparatus of claim 1, wherein the base plate is reversibly removably installable to the arm.

14. A chemical mechanical polishing apparatus comprising:

a platen to hold a polishing pad;

a carrier head to hold a substrate against a polishing surface of the polishing pad during a polishing process; and a temperature control system including a source of heated fluid and an arm extending over the platen, the arm having a base plate forming a bottom of the arm, wherein a plurality of openings having predetermined fixed sizes extend from a common plenum in the arm through the base plate, wherein the common plenum is coupled to the source of heated fluid, wherein the arm is located such that the openings are positioned over the platen for by a gap to deliver the heated fluid from the common plenum onto the polishing pad, wherein each of a first plurality of radial positions along the common plenum has at least two laterally separated openings, and wherein each of a second plurality of radial positions along the common plenum has a single opening.

15. The apparatus of claim 14, wherein the temperature control system includes a second arm extending over the platen, the second arm having a second base plate forming a bottom of the second arm, wherein a second plurality of second openings having predetermined fixed sizes extending from a second common plenum in the second arm through the second base plate, wherein the second common plenum is coupled to a source of coolant, wherein the arm is located such that the openings are positioned over the platen and separated from the polishing pad by a gap to deliver the coolant onto the polishing pad, wherein each of a first plurality of radial positions along the second common plenum has at least two laterally separated second openings, and wherein each of a second plurality of radial positions along the second common plenum has a single second opening.

16. A chemical mechanical polishing apparatus comprising:

a rotatable platen to hold a polishing pad;

a carrier head to hold a substrate against a polishing surface of the polishing pad during a polishing process; and a temperature control system including a source of heated fluid and an arm extending over the platen, the arm having a base plate forming a bottom of the arm, wherein a plurality of openings having predetermined fixed sizes extend from a common plenum in the arm through the base plate, wherein the common plenum is coupled to the source of heated fluid, wherein the arm is located such that the openings are positioned over the platen and separated from the polishing pad by a gap to deliver a heated fluid from the common plenum onto the polishing pad, wherein positions and sizes of the openings are such that a mass flow rate of the heated fluid through the plurality of openings increases substantially parabolically with a distance from an axis of rotation of the platen.

17. A method of controlling polishing, comprising:

measuring a radial temperature profile of a first polishing pad during polishing of a substrate;

determining a pattern of openings that provide a mass flow profile to compensate for non-uniformity in the radial temperature profile;

obtaining a base plate having a plurality of openings having predetermined fixed sizes arranged in the pattern;

installing the base plate in an arm of a temperature control system of a chemical mechanical polishing system to form a common plenum with the plurality of openings positioned over a platen; and polishing a substrate with a second polishing pad in the chemical mechanical polishing system while supplying a source of heating or coolant fluid to the common plenum such that the fluid flows through the plurality of openings onto the second polishing pad.

18. The method of claim 17, wherein obtaining the base plate comprises fabricating the base plate.

19. The method of claim 17, wherein obtaining the base plate comprises selecting the base plate from a plurality of pre-fabricated base plates.

* * * * *